US008408099B2

(12) United States Patent
Liou

(10) Patent No.: US 8,408,099 B2
(45) Date of Patent: Apr. 2, 2013

(54) TOOL WITH WORKING HEADS AND POSITIONING UNIT

(76) Inventor: Mou-Tang Liou, Ta Li (TW)

( * ) Notice: Subject to any disclaimer, the term of this patent is extended or adjusted under 35 U.S.C. 154(b) by 370 days.

(21) Appl. No.: 12/833,107

(22) Filed: Jul. 9, 2010

(65) Prior Publication Data

US 2012/0006159 A1 Jan. 12, 2012

(51) Int. Cl.
*B25B 23/16* (2006.01)

(52) U.S. Cl. ..... 81/177.8; 81/177.2

(58) Field of Classification Search ..... 81/177.8, 81/177.2, 177.7, 177.85, 177.9, 177.6, DIG. 9, 81/488; 7/138, 168; D8/28, 105
See application file for complete search history.

(56) References Cited

U.S. PATENT DOCUMENTS 1,247,707 A * 11/1917 Morich ..... 7/138
1,269,413 A * 6/1918 Finnigan ..... 81/177.2
2,028,561 A * 1/1936 Pilger ..... 81/177.9
D485,143 S * 1/2004 Yang ..... D8/28
7,000,507 B1 * 2/2006 Lin ..... 81/177.9

FOREIGN PATENT DOCUMENTS

TW 492908 7/1991

* cited by examiner

*Primary Examiner* — Hadi Shakeri
(74) *Attorney, Agent, or Firm* — Alan Kamrath; Kamrath IP Lawfirm, P.A.

(57) ABSTRACT

A tool includes a handle including a pivotal end, a holding end held by the user in use of the tool and a plurality of teeth formed on an outer periphery of the pivotal end. A first working head includes a pivotal end coupled to the pivotal end of the handle pivotally, a working end engaged with a work piece desired to be driven and an aperture between the pivotal end of the first working head and the working end. A positioning unit includes a positioning plate and an elastic element received in the aperture, with the positioning plate hooking the first working head and pressing the elastic element of the positioning unit respectively. A restricted portion protrudes from the positioning plate between two ends of the positioning plate toward the pivotal end of the handle.

14 Claims, 20 Drawing Sheets

TOOL WITH WORKING HEADS AND POSITIONING UNIT

BACKGROUND OF THE INVENTION

1. Field of the Invention

The present invention relates to a tool with working heads and a positioning unit and, more particularly, to a tool with a positioning unit and working heads with angles respectively between the working heads and a handle of the tool being adjustable.

2. Description of the Related Art

Disclosed in Taiwan Patent No. 492908 is a pry tool including a prying head and a handle pivotable with respect to the pry head. A side of an end of the prying head has a plurality of positioning slots adjacent to the periphery thereof, and a plate is coupled to a side of the handle pivotally. The plate is engaged with one of the positioning slots for fixing the handle to the prying head at a desired angle.

The handle has two spaced lugs corresponding to the end of the prying head where the positioning holes are formed. Through-holes are defined on the lugs respectively, and a pin is provided to insert through the through-holes and pivotally coupled to the plate. However, the prying head which includes positioning holes should be coupled to a large-volume handle, and it results in shortcomings that the handle would be heavy, the lugs would be easy to be broken and the product-cost would increase for assembly of the handle and the plate. Moreover, the positioning slots are provided on the side of the prying head, and each has a certain width, so that the positioning slots and the handle can be adjusted to fix to each other at several desired angles.

SUMMARY OF THE INVENTION

According to the present invention, it shows a tool with working heads and a positioning unit adapted to fix the working heads to a handle of the tool respectively at several desired angles.

One objective of the present invention is that the tool is a simple-structure and light-weight. There is no need to include an additional component for fixing the positioning unit onto the tool. It's a quick and easy assembly of the positioning unit to the tool for decreasing the product cost and time.

DETAILED DESCRIPTION OF THE PREFERRED EMBODIMENT EMBODIMENTS

Figure 1:
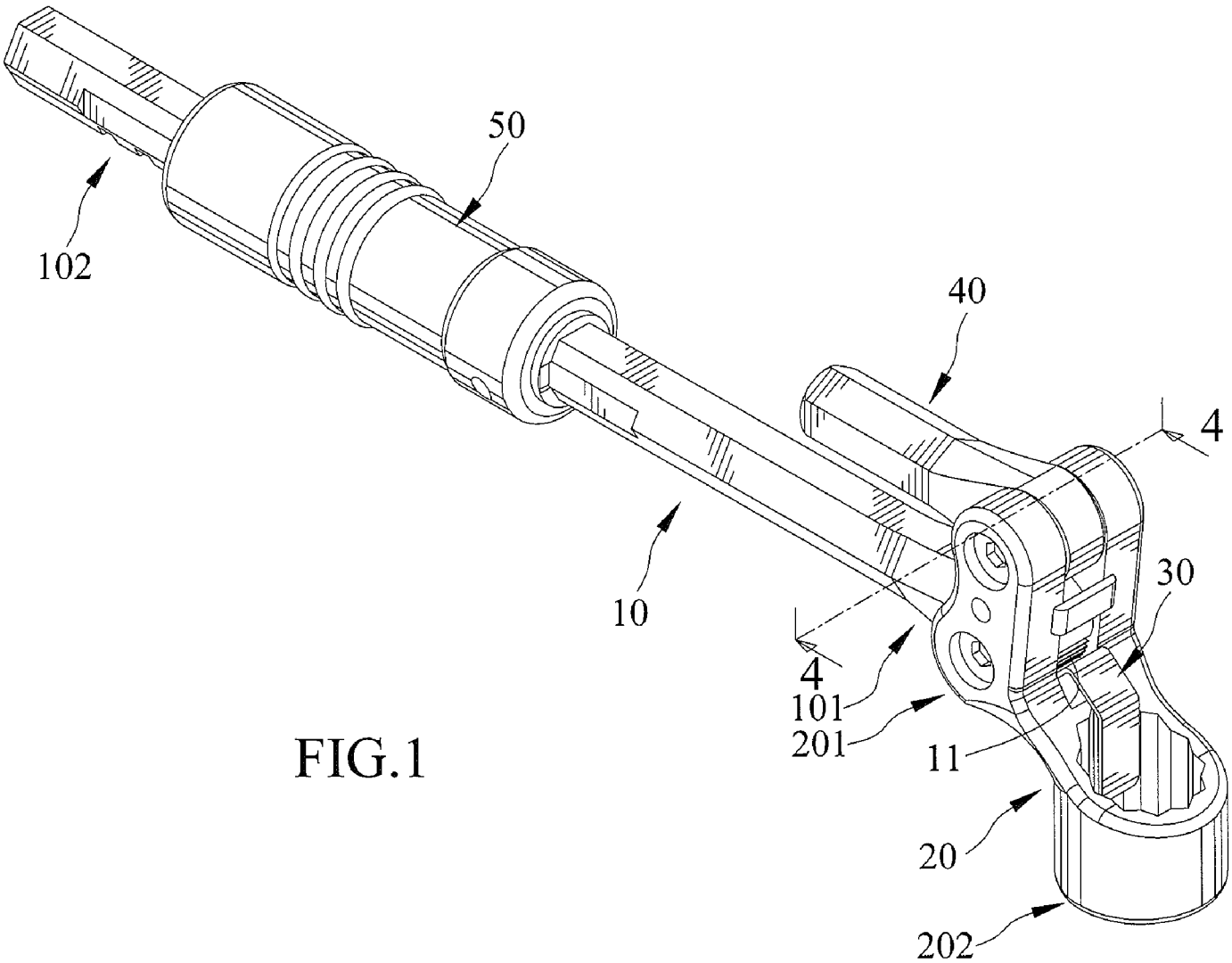
FIG. 1 is a perspective view of a tool with working heads and positioning unit according to the first embodiment of the present invention.
Figure 2:
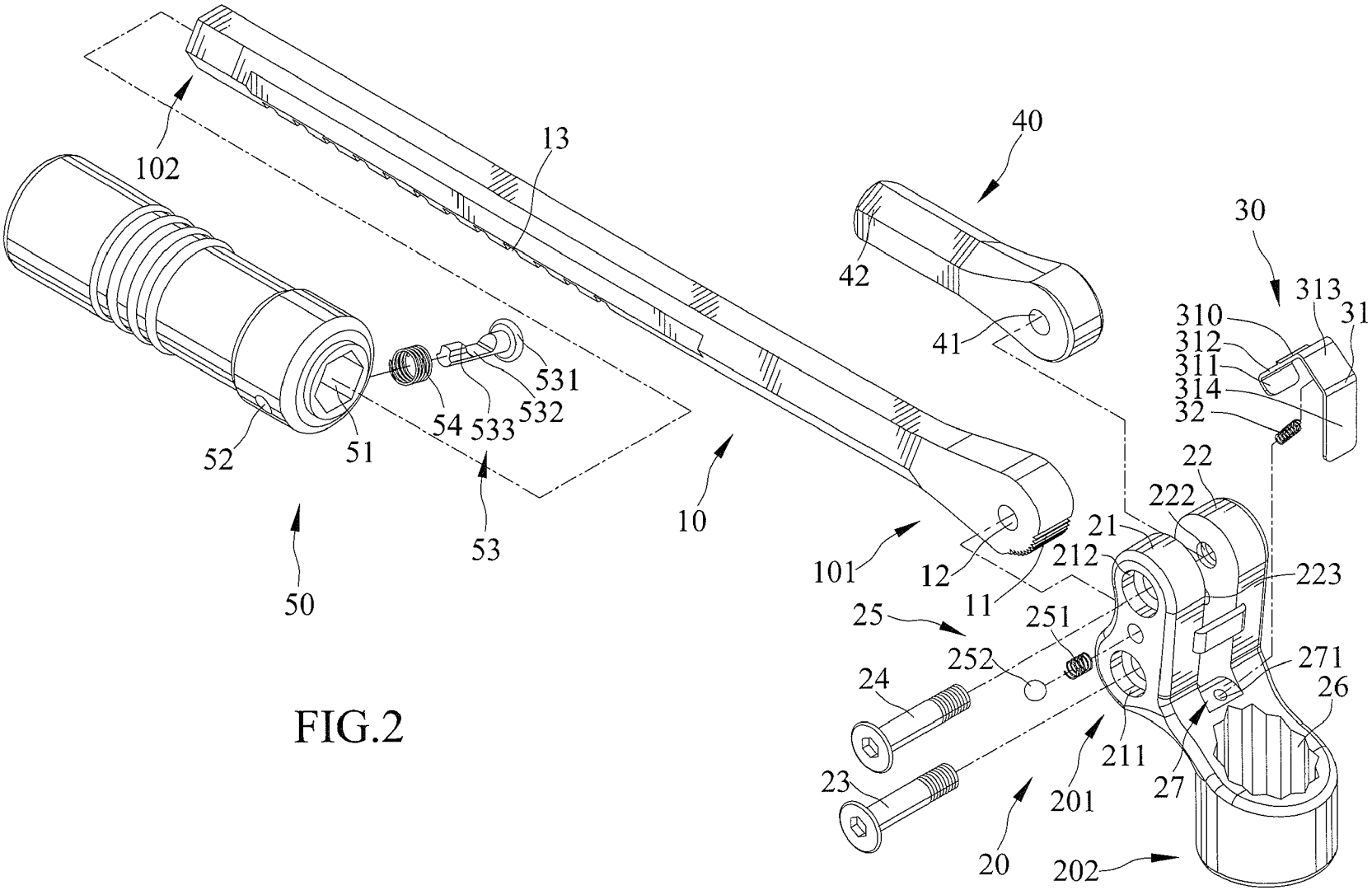
FIG. 2 is an exploded, perspective view of the tool as shown in FIG. 1.
Figure 3:
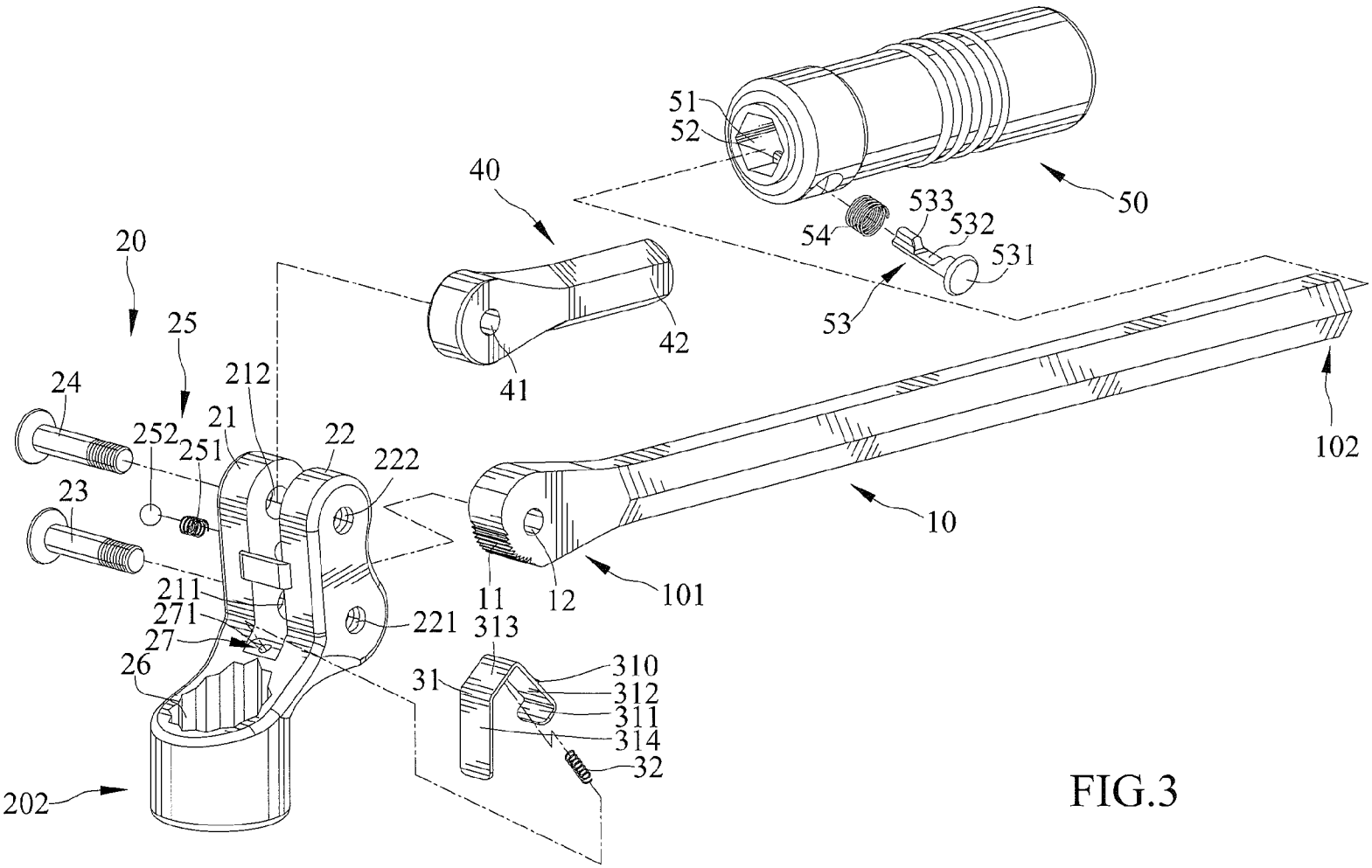
FIG. 3 is another exploded, perspective view of the tool as shown in FIG. 1.
Figure 4:
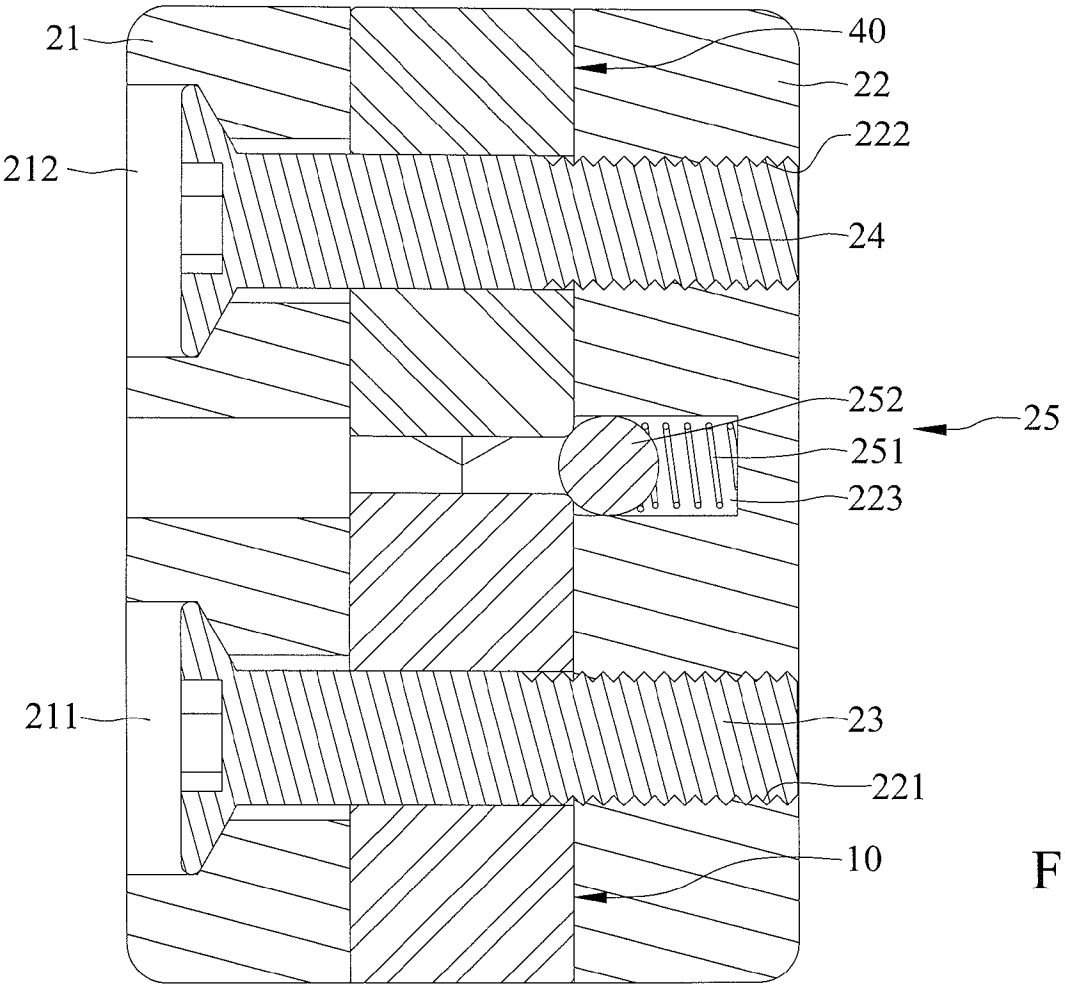
FIG. 4 is a cross-sectional view taken along 4-4 in FIG. 1.
Figure 5:
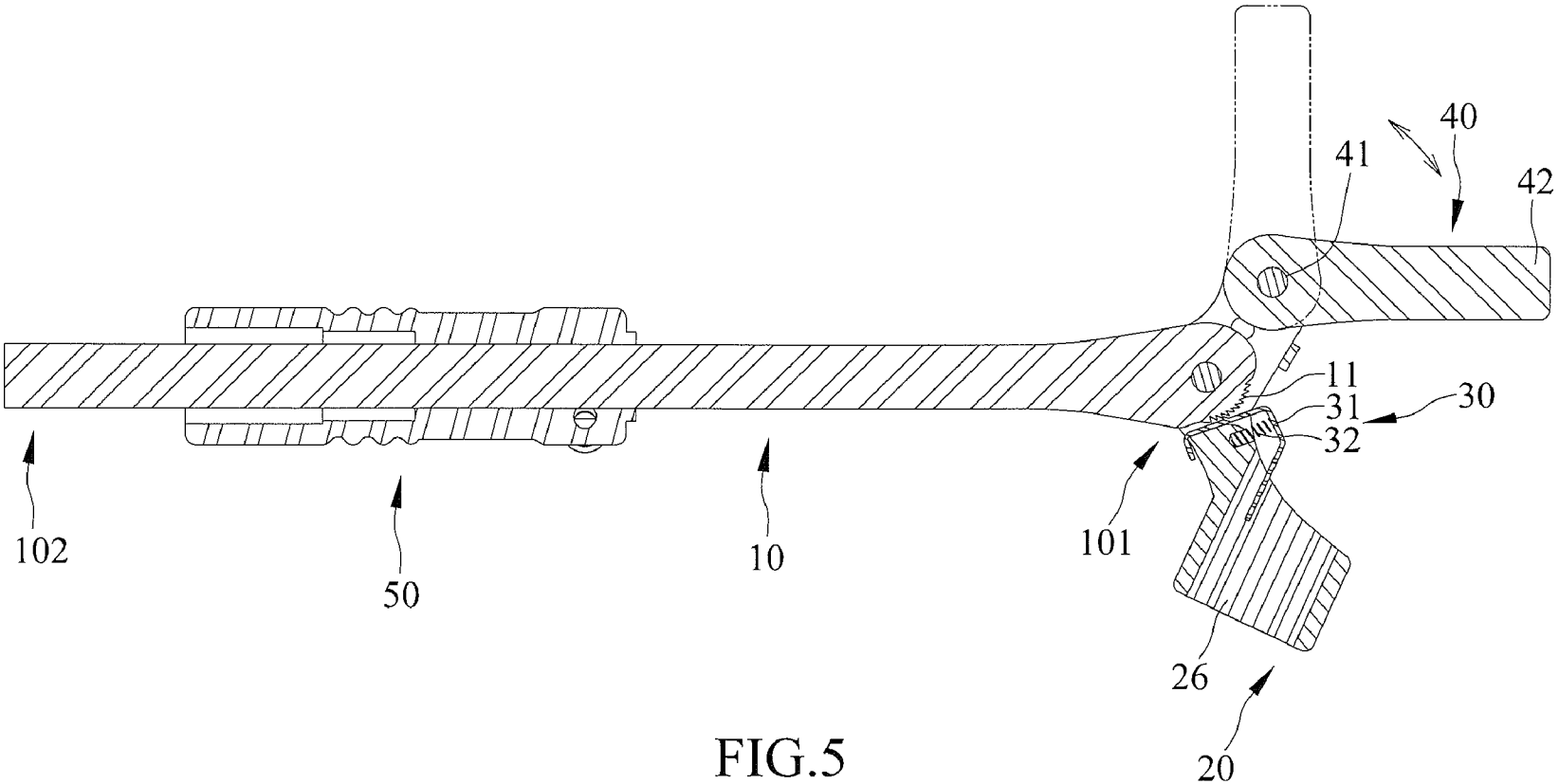
FIG. 5 is a cross-sectional view of the tool as shown in FIG. 1, illustrating the second working head pivoted with respect to the pivotal end of the first working head.
Figure 6:
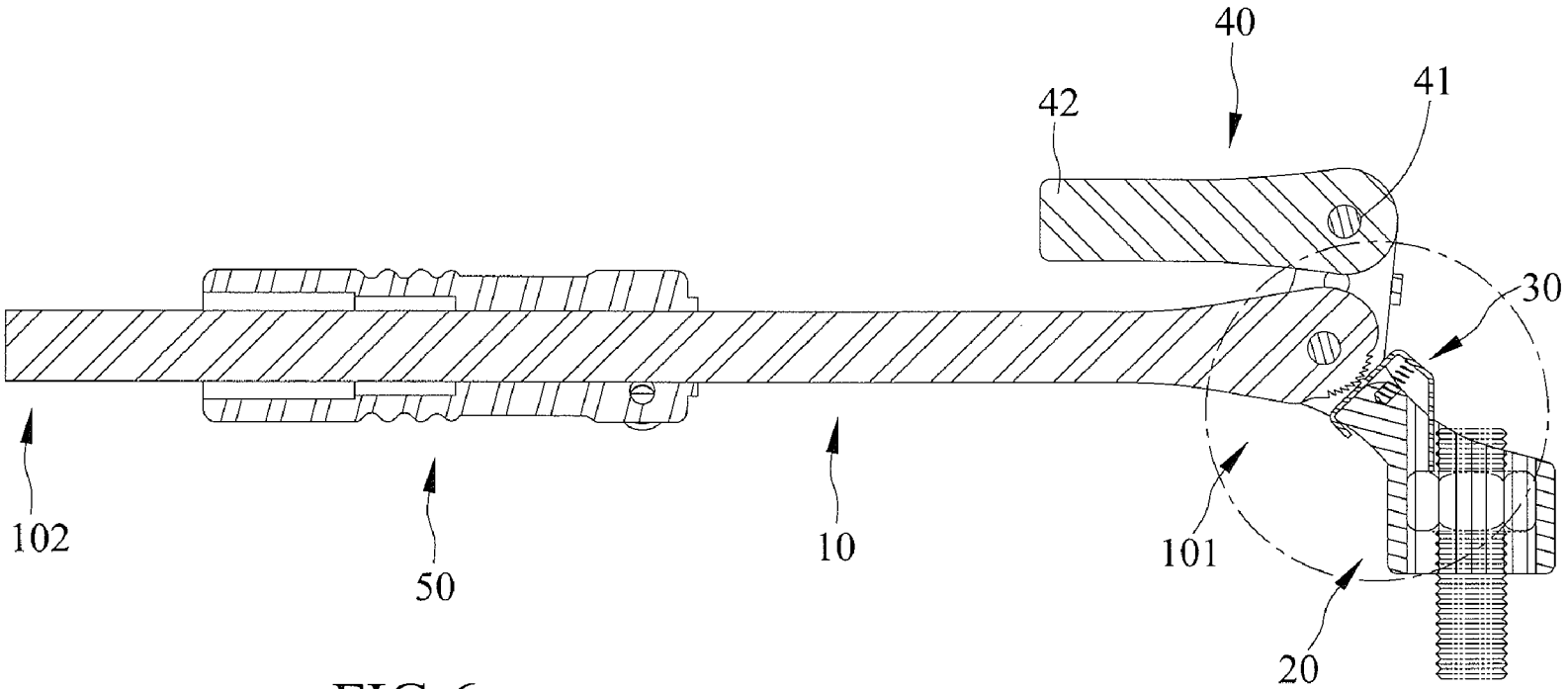
FIG. 6 is a cross-sectional view similar to FIG. 5.
Figure 7:
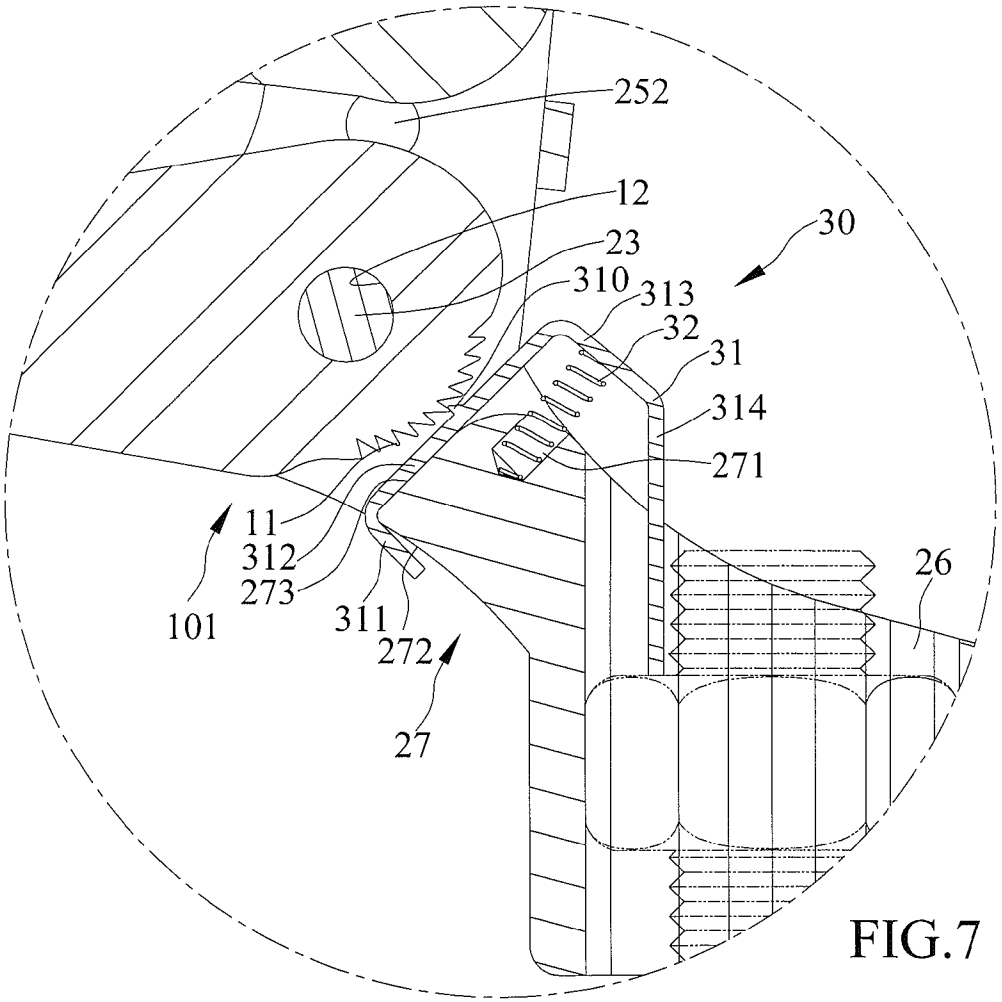
FIG. 7 is an enlarged detailed sectional view taken in FIG. 6.
Figure 9:
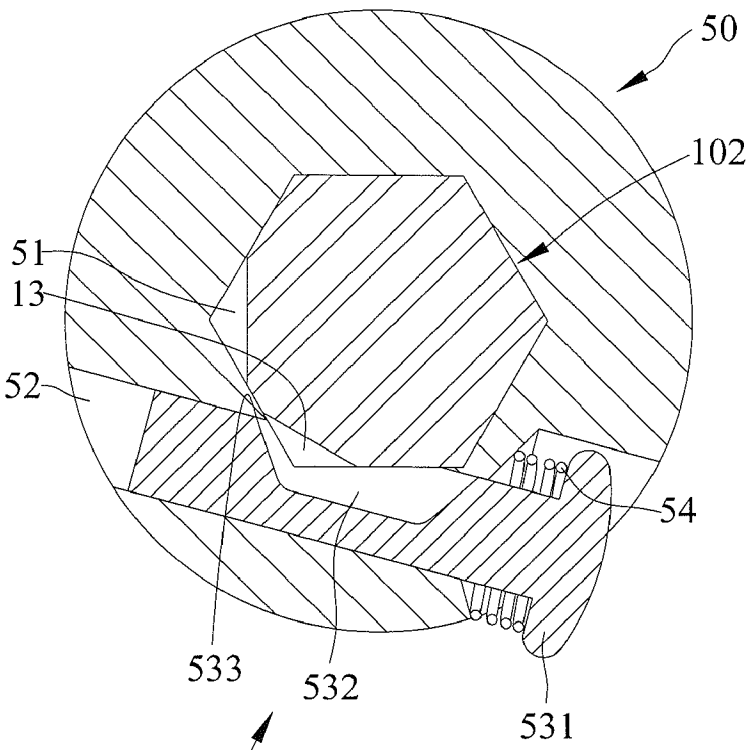
FIG. 9 is another cross-sectional view of the elongate rod of the tool as shown in FIG. 1, illustrating the elongate rod moveable with respect to the handle.
Figure 8:
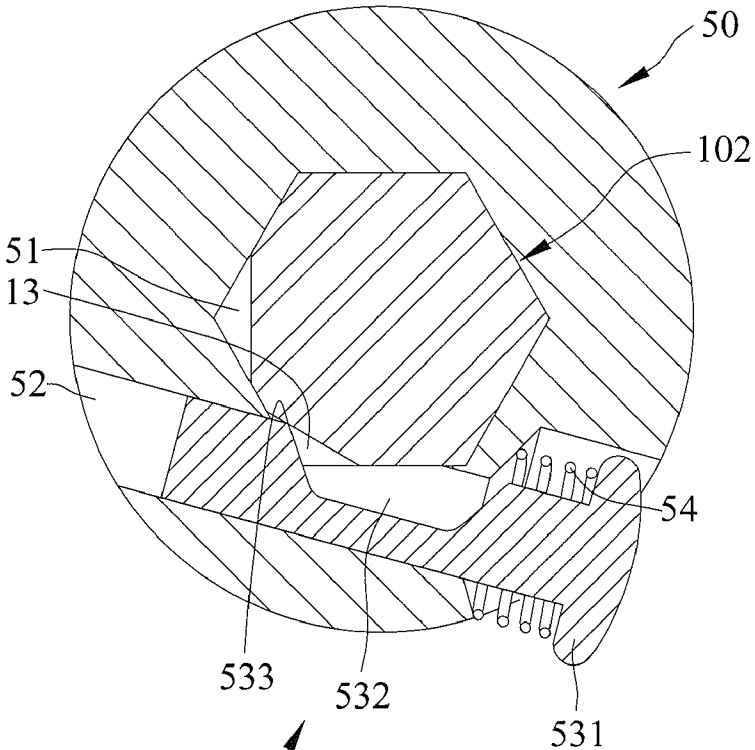
FIG. 8 is a cross-sectional view of the elongate rod of the tool as shown in FIG. 1, illustrating the elongate rod cannot move with respect to the handle.
Figure 10:
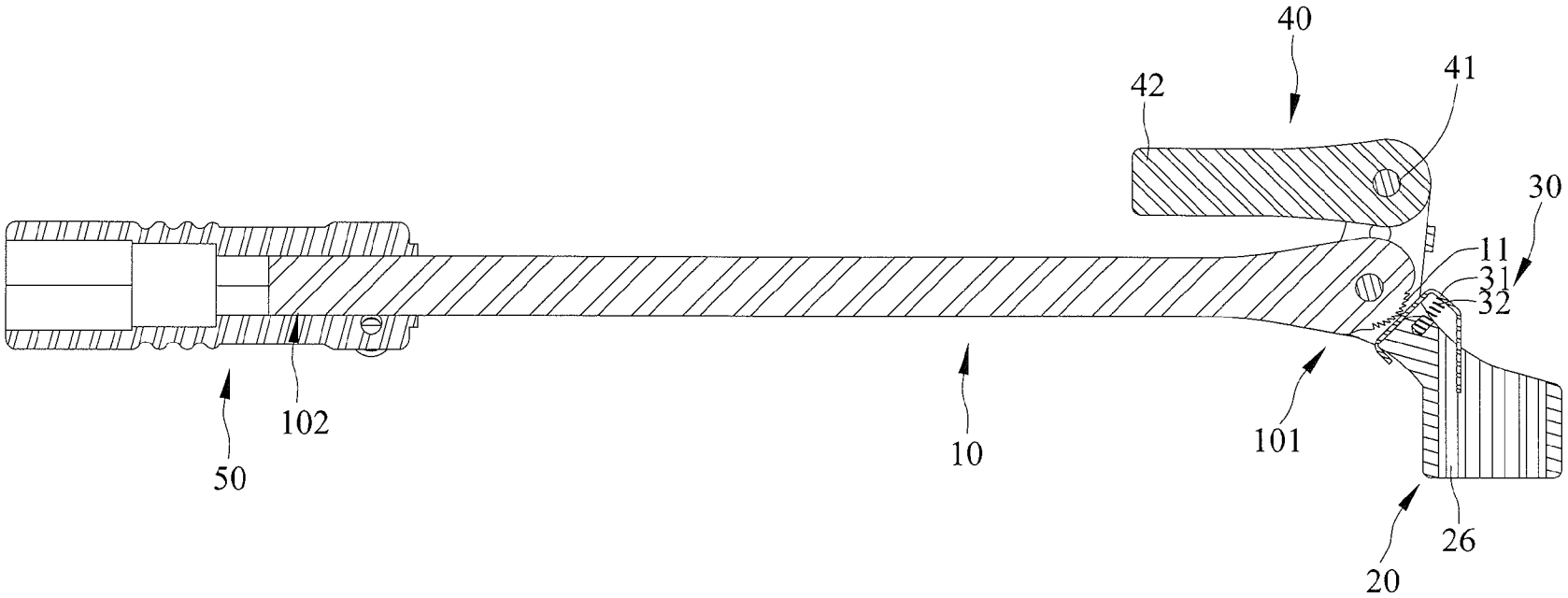
FIG. 10 is a cross-sectional view of the tool as shown in FIG. 1, illustrating the entire length of the handle increases by moving the elongate rod with respect to the handle.

FIGS. 1 through 14 show a tool with working heads and a positioning unit in accordance with a first embodiment of the present invention. The tool includes a handle 10, which has a flat pivotal end 101 and a holding end 102 opposite to the pivotal end 101, and a plurality of ratchet-like teeth 11 formed on a part of the outer periphery of the pivotal end 101. A user can hold the holding end 102 to operate the tool during work. A spacing of two intersections of the teeth 11 is small for fine-adjustment of the pivotal angle between the handle 10 and a first working head 20.

The first working head 20 has a pivotal end 201 pivotally coupled to the pivotal end 101 of the handle 10 and a working end 202 adapted to engage with a work piece desired to be driven.

A positioning unit 30 is adjustable between a first position and a second position. In the first position of the positioning unit 30, the handle 10 is fixed with respect to the first working head 20. In the second position of the positioning unit 30, the handle 10 is pivotable with respect to the first working head 20.

A second working head 40 is pivotally coupled to the pivotal end 201 of the first working head 20 and includes a pivoted hole 41 formed at a first end thereof and a hexagonal driving portion 42 provided at a second end thereof opposite to the pivoted hole 41. The driving portion 42 can be engaged with hexagonal fasteners.

An elongate rod 50 is mounted onto the holding end 102 of the handle 10 and adapted for increasing the entire length of the handle 10 adjustably. During use, users grip the elongate rod 50 to pivot the handle 10 with respect to the first working head 20. It increases the length of a force arm, which is the distance from the connection of the first working head 20 and the handle 10 to the distal end of the elongate rod 50, and provides a more comfortable hold of the tool.

The pivotal end 101 of the handle 10 is formed with a pivotal hole 12 and the holding end 102 has hexagonal cross-sections. A plurality of evenly spaced positioning portions 13 is formed along the holding end 102 linearly, and each is in a form of an open slot.

Spaced first and second pivotal lugs 21, 22 and first and second axles 23, 24 are provided at the pivotal end 201 of the first working head 20. The first pivotal lug 21 has a first hole 211 and a second hole 212 spaced from the first hole 211. The second pivotal lug 22 has spaced first and second fixed holes 221, 222, which respectively correspond to the first and second holes 211, 212, and a receiving hole 223 between the first and second fixed holes 221, 222. A biasing member 25 is disposed in the receiving hole 223 and includes an elastic element 251 and a ball 252. The first axle 23 is inserted through the first hole 211 and the pivotal hole 12 and is fixed to the first fixed hole 221 for pivotally coupling the handle 10 to the first working head 20.

The pivotal end 101 of the handle 10 and the first end of the second working head 40 are respectively pivotally coupled to the pivotal end 201 of the first working head 20 and respectively biased by the ball 252 of the biasing member 25 simultaneously. The biasing member 25 is moveable between a releasing position and a pushed position. In the pushed position of the biasing member 25 by pivoting the pivotal end 101 of the handle 10 and the first end of the second working head 40, the ball 252 pushes the pivotal end 101 of the handle 10 and the first end of the second working head 40 by the released elastic element 251 to adjust the pivotal end 101 of the handle 10 and the first end of the second working head 40 respectively with respect to the pivotal end 201 of the first working head 20 in several positions. After a user stops to pivot the pivotal end 101 of the handle 10 and the first end of the second working head 40, the biasing member 25 is in the releasing position, and the elastic element 251 simultaneously pushes the ball 252 toward the pivotal end 101 of the handle 10 and the first end of the second working head 40 for fixing the pivotal end 101 of the handle 10 and the first end of the second working head 40 with respect to the pivotal end 201.

The second axle 24 is inserted through the second hole 212 and the pivoted hole 41 and is fixed to the second fixed hole 222 for pivotally coupling the handle 10 to the second working head 40.

A driving hole 26 is formed on the working end 202 of the first working head 20 and, in this case, is capable of engaging with the work piece, like a hexagonal fastener or nut, desired to be driven.

A connective portion 27 is defined between the pivotal end 201 and the working end 202 and between the first and second pivotal lugs 21, 22. A direction extending from the connective portion 27 to the pivotal end 201 and a direction extending from the connective portion 27 to the working end 202 are not in the same plane. The connective portion 27 has first, second and third sides. The first side extends from the top surface of the working end 202 and has an aperture 271, the second side is opposite to the first side and defines a retained side 272 and the third side faces the pivotal end 101 between the first and second sides and defines an abutted side 273.

The positioning unit 30 includes a positioning plate 31, which is made of a bent sheet metal and is formed with first, second, third and fourth sections 311, 312, 313, 314, and an elastic element 32 received in the aperture 271 and pushing the positioning plate 31. The first, second, third and fourth sections 311, 312, 313, 314 are continuously coupled to one another in sequence.

The positioning plate 31 directly hooks the connective portion 27 without any additional component for a quick-assembly of the positioning plate 31 to the first working head 20. The first section 311 hooks the connective portion 27 on the retained side 272, the second section 312 is bent from the first section 311 and is abutted against the abutted side 273, the third section 313 is bent from the second section 312 and is pushed by the elastic element 32 outwardly and the fourth section 314 is bent from the third section 313 and inserted into the driving hole 26. A direction of the first section 311 is substantially parallel to that of the third section 313 and perpendicular to that of the second section 312. An angle between the third and fourth sections 313, 314 is larger than 90 degrees. The fourth section 314 prevents the third section 313 from deforming easily via a frequent push of the elastic element 32.

A restricted portion 310 is protruded from the positioning plate 31 between two ends of the positioning plate 31 and, in this case, is defined on the second section 312.

When the positioning unit 30 is in the first position, the restricted portion 310 is engaged with one tooth 11 of the handle 10. Then sliding the positioning plate 31 with respect to the connective portion 27 to detach the restricted portion 310 from the one tooth 11 makes the positioning unit 30 to be in the second position, so that the first working head 20 is able to pivot with respect to the handle 10. The small spacing between each two intersections of the teeth 11 allows the first working head 20 to be fixed with respect to the handle 10 at various angles.

The elongate rod 50 includes a hexagonal mounted hole 51 mounted onto the holding end 102, a through-hole 52 partially communicating with the mounted hole 51, a controller 53 and an elastic element 54. A direction of the mounted hole 51 is perpendicular to that of the through-hole 52. The controller 53 includes a head 531, an abutted surface 533 and a sunken portion 532 between the head 531 and the abutted surface 533. The controller 53 is inserted though the elastic element 54 and disposed in the through-hole 52. The sunken portion 532 allows the holding end 102 to be able to pass through the controller 53. The abutted surface 533 is selectively engaged with one positioning portion 13 for preventing the elongate rod 50 from sliding with respect to the handle 10. By pressing the head 531 of the controller 53 toward the mounted hole 51, the abutted surface 533 is forced to disengage from the one positioning portion 13 so that the elongate rod 50 is able to slide with respect to the handle 10.

The handle 10 is capable of pivoting with respect to the first working head 20 along first or second directions selectively.

Figure 11:
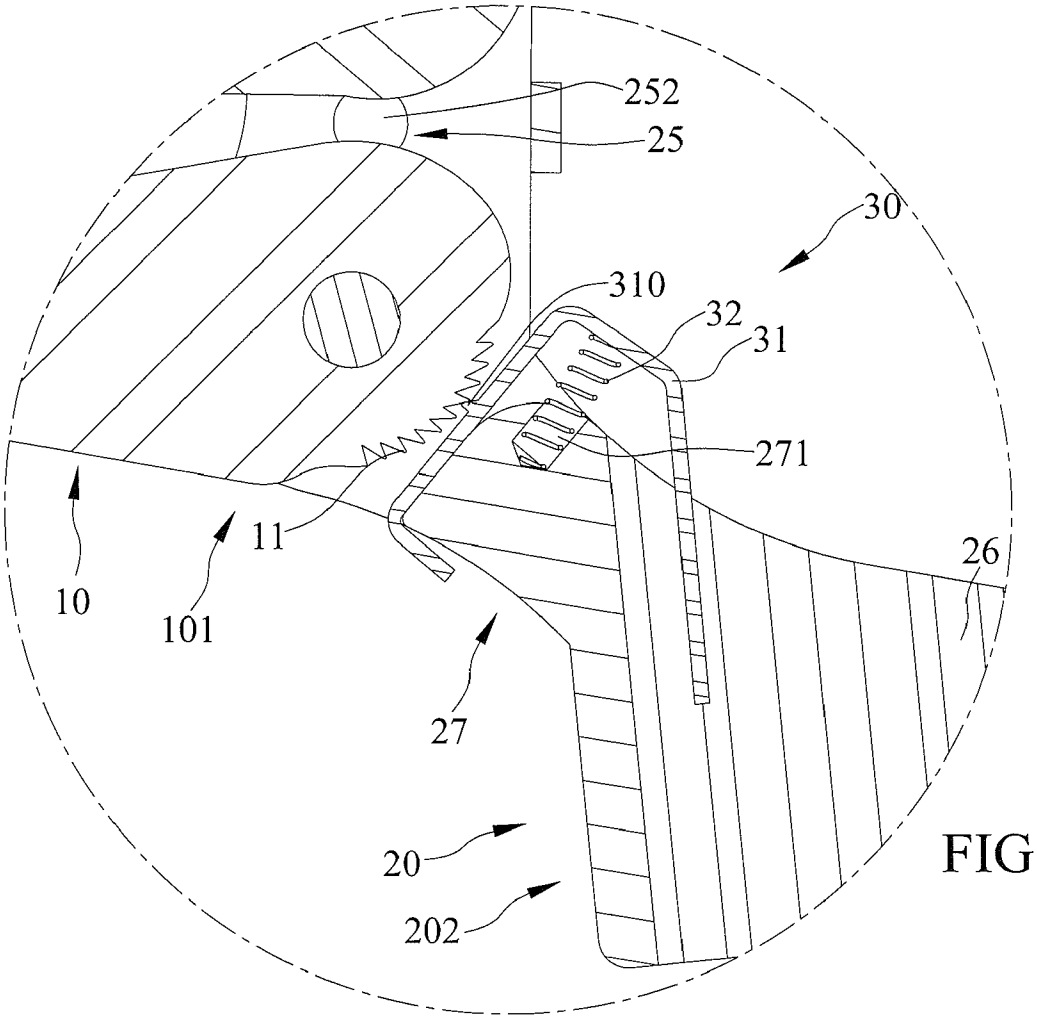
FIG. 11 is an enlarged detailed sectional view similar to FIG. 7, illustrating the handle pivoted with respect to the pivotal end of the first working head in the first direction.

Referring to FIG. 11, while the handle 10 is pivoted with respect to the first working head 20 along the first direction, the pivotal end 101 presses the ball 252, and the restricted portion 310 can skip from one tooth 11 to another tooth 11 for adjusting the angle between the handle 10 and the first working head 20. As the working end 202 is engaged with the work piece desired to be driven, the user can hold the handle 10 to pivot with respect to the first working head 20 along the first direction with only one hand.

Figure 12:
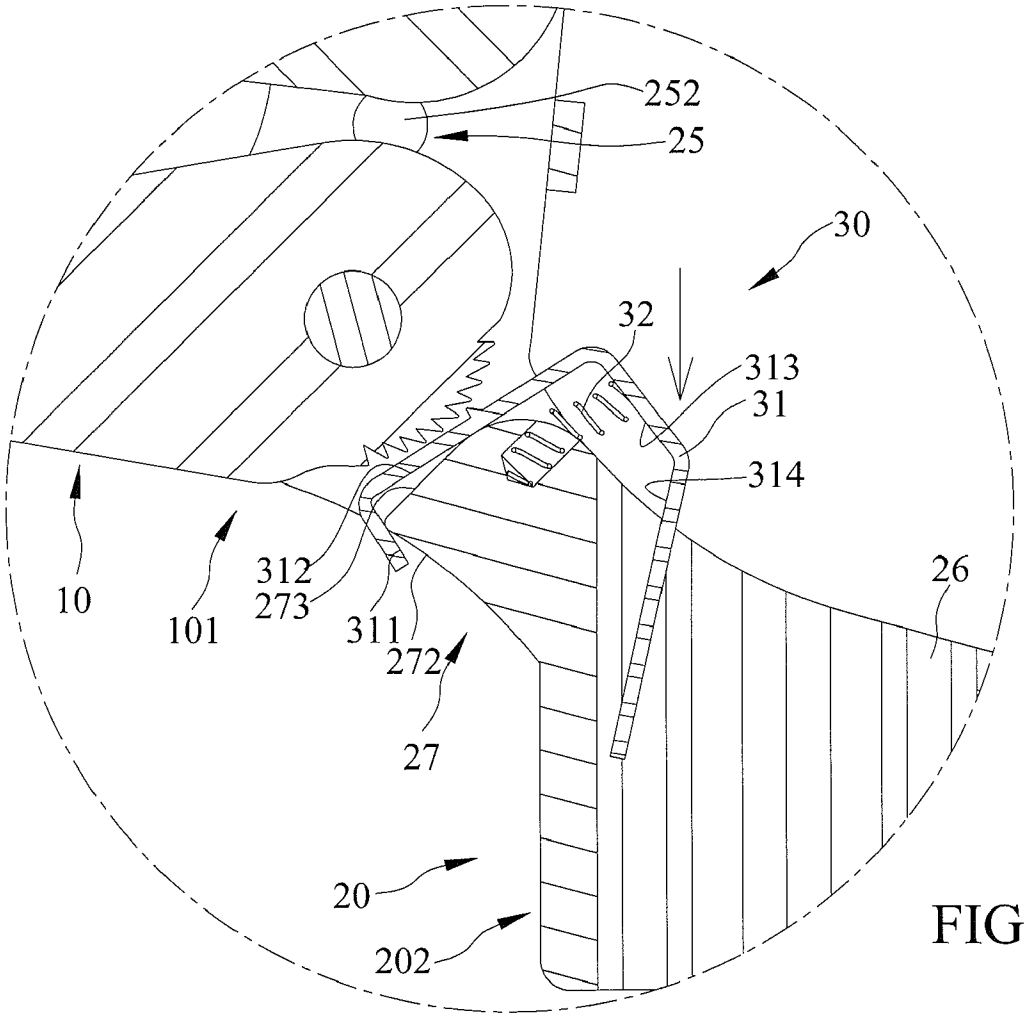
FIG. 12 is an enlarged detailed sectional view similar to FIG. 11, illustrating the handle pivoted with respect to the pivotal end of the first working head in the second direction.
Figure 13:
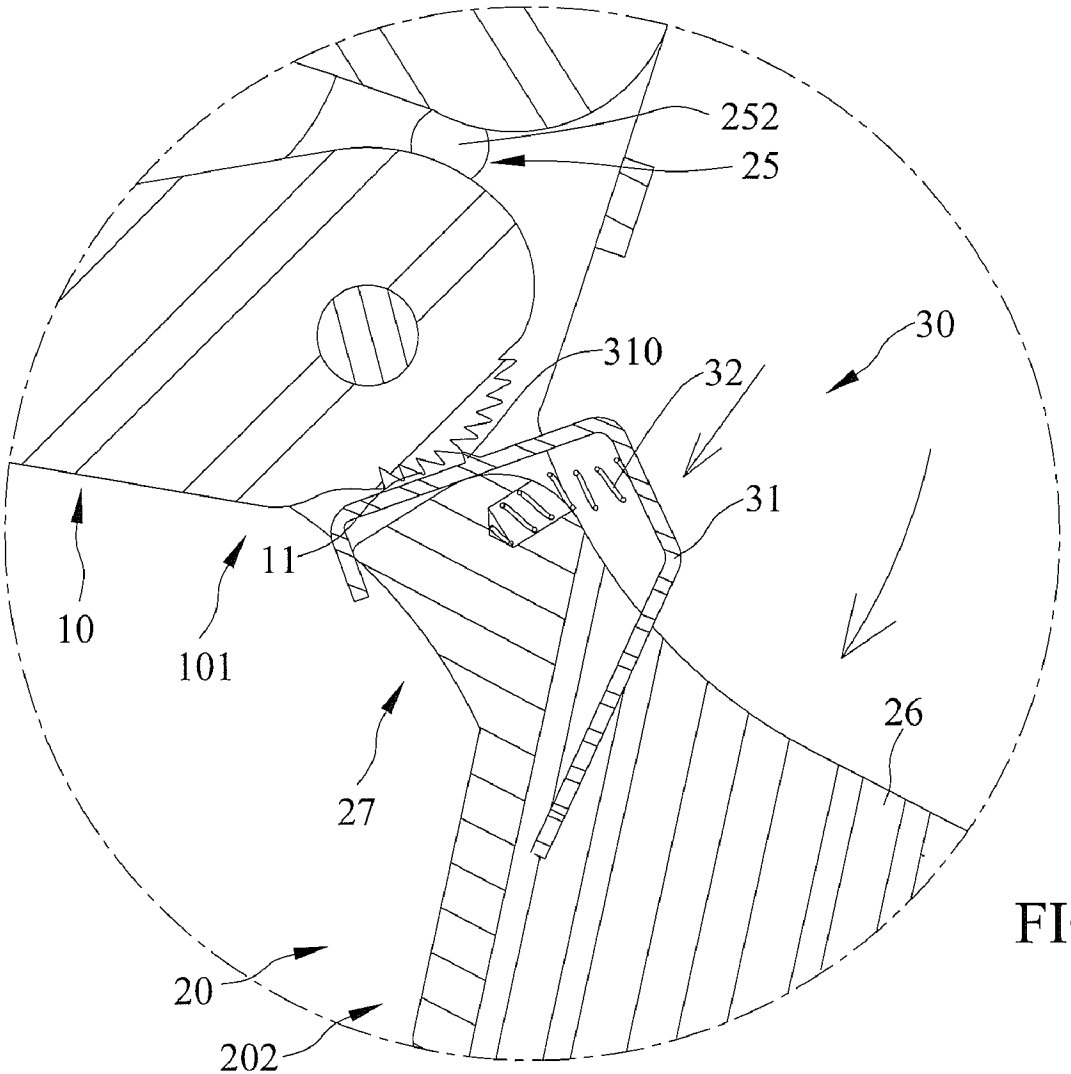
FIG. 13 is an enlarged detailed sectional view similar to FIG. 12.
Figure 14:
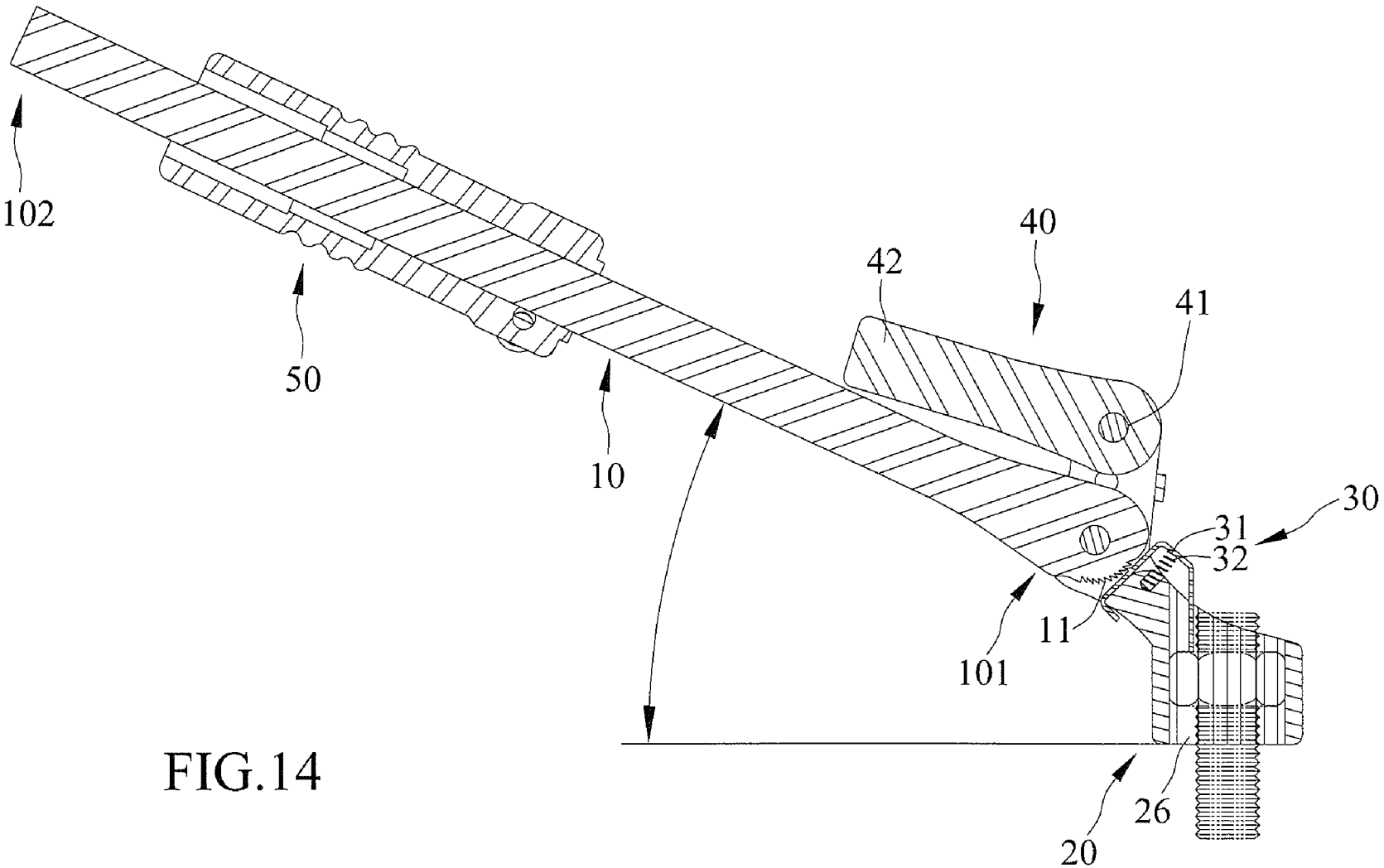
FIG. 14 is a cross-sectional view of the tool as shown in FIG. 1, illustrating the handle pivoted to an ideal angle with respect to a plane where a fastener engaged with the working end of the first working head is located.
Figure 15:
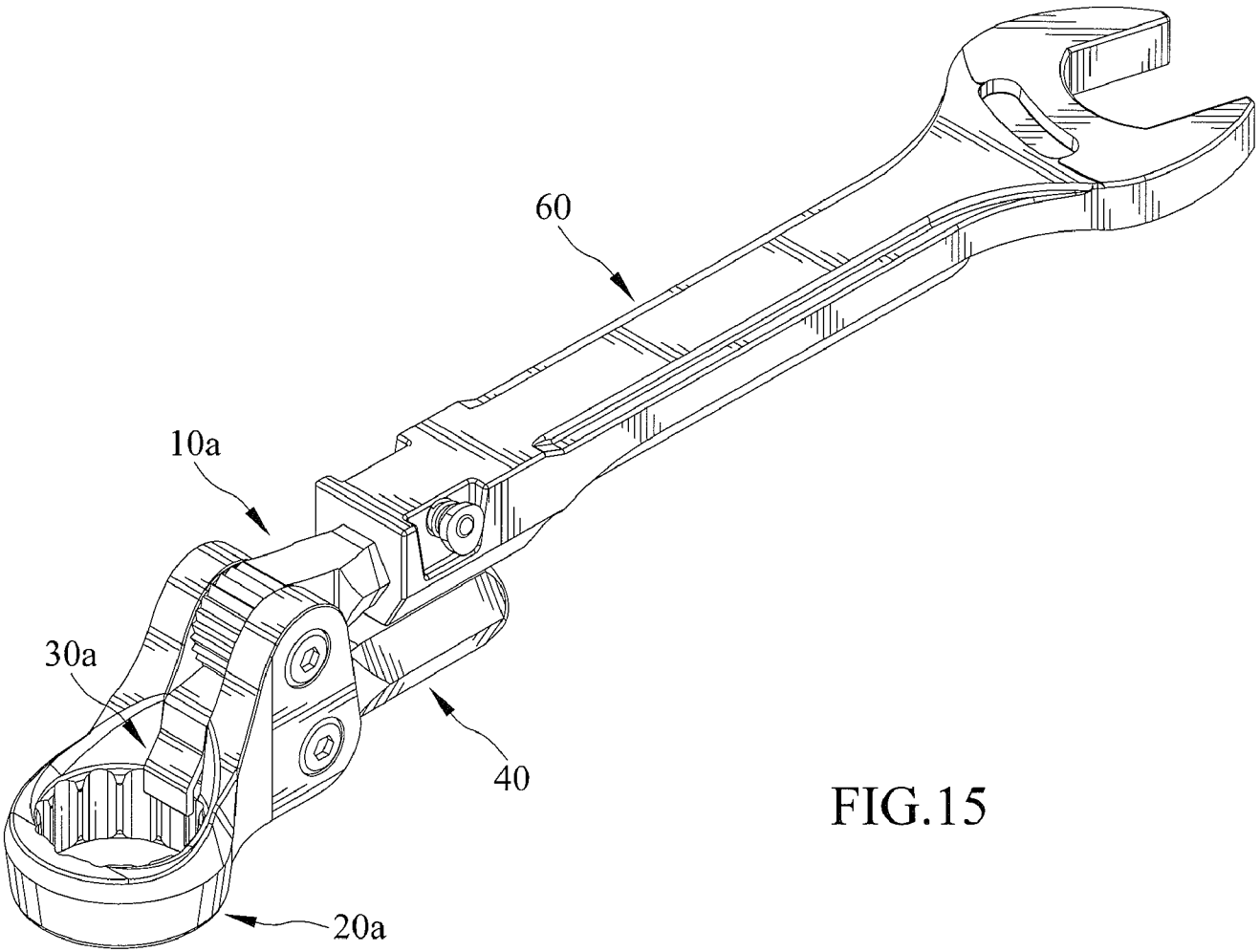
FIG. 15 is a perspective view of a tool with working heads and a positioning unit according to the second embodiment of the present invention.
Figure 16:
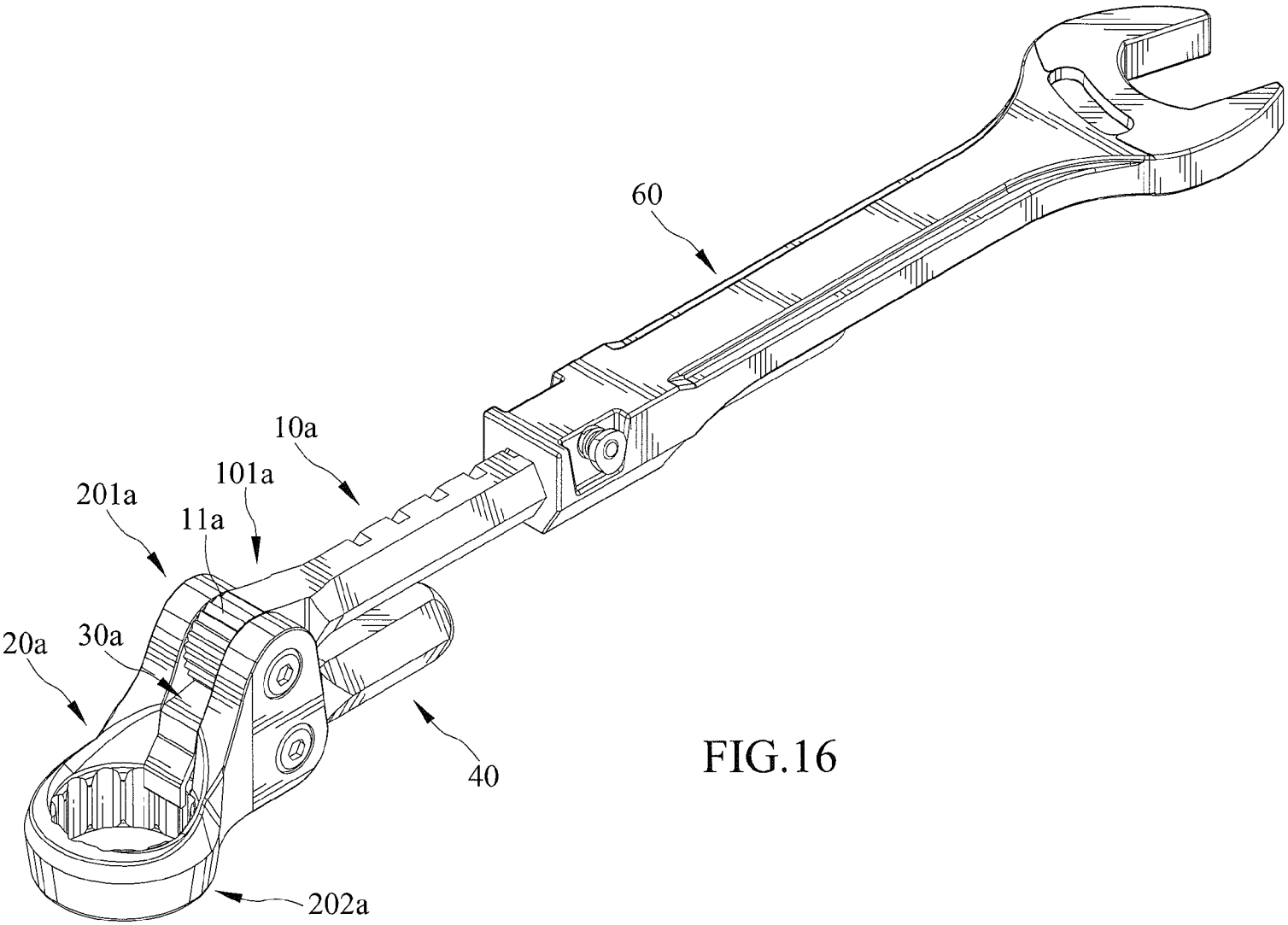
FIG. 16 is another perspective view of the tool as shown in FIG. 15, illustrating the entire length of the handle increases by moving the elongate rod with respect to the handle.
Figure 17:
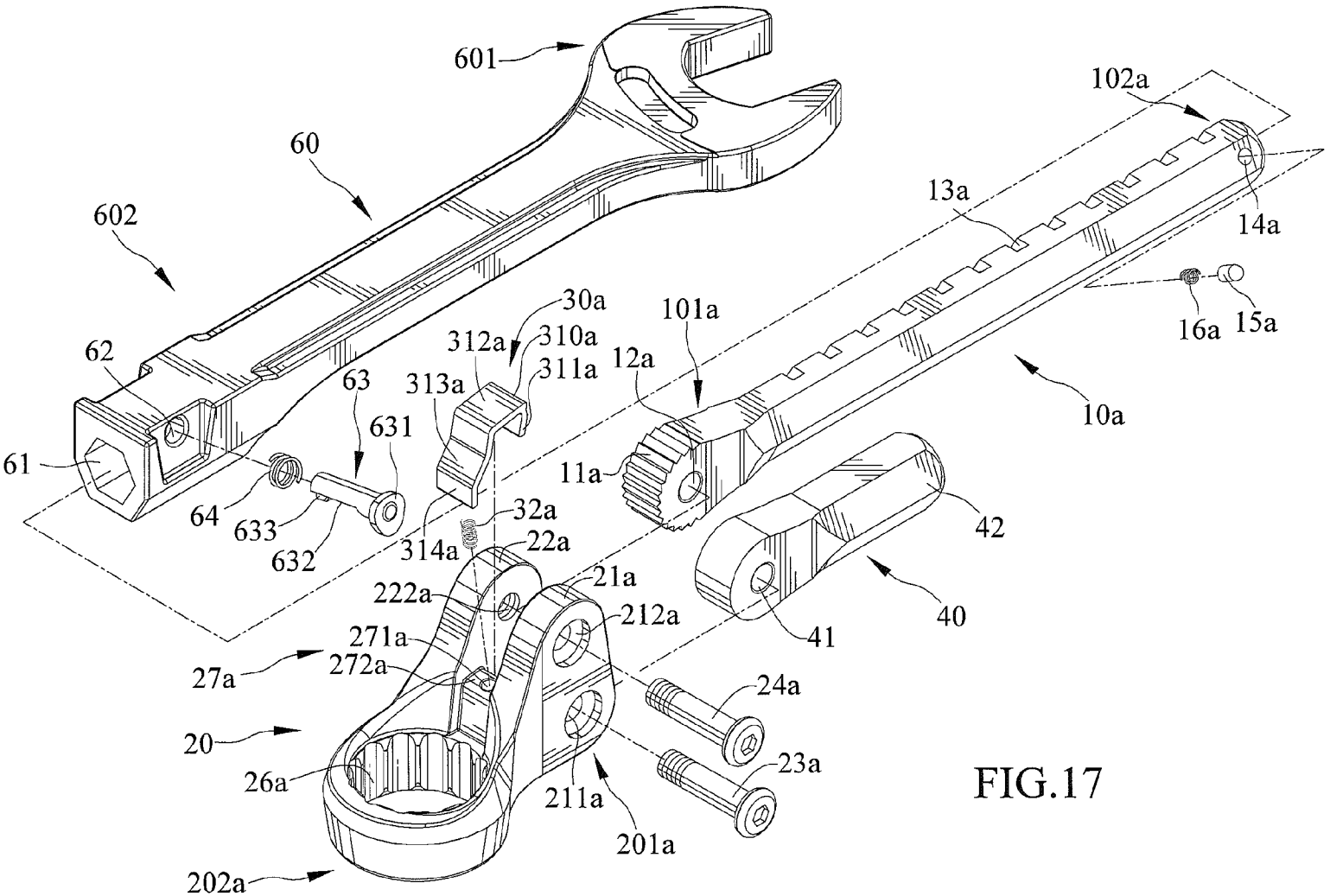
FIG. 17 is an exploded, perspective view of the tool as shown in FIG. 15.
Figure 18:
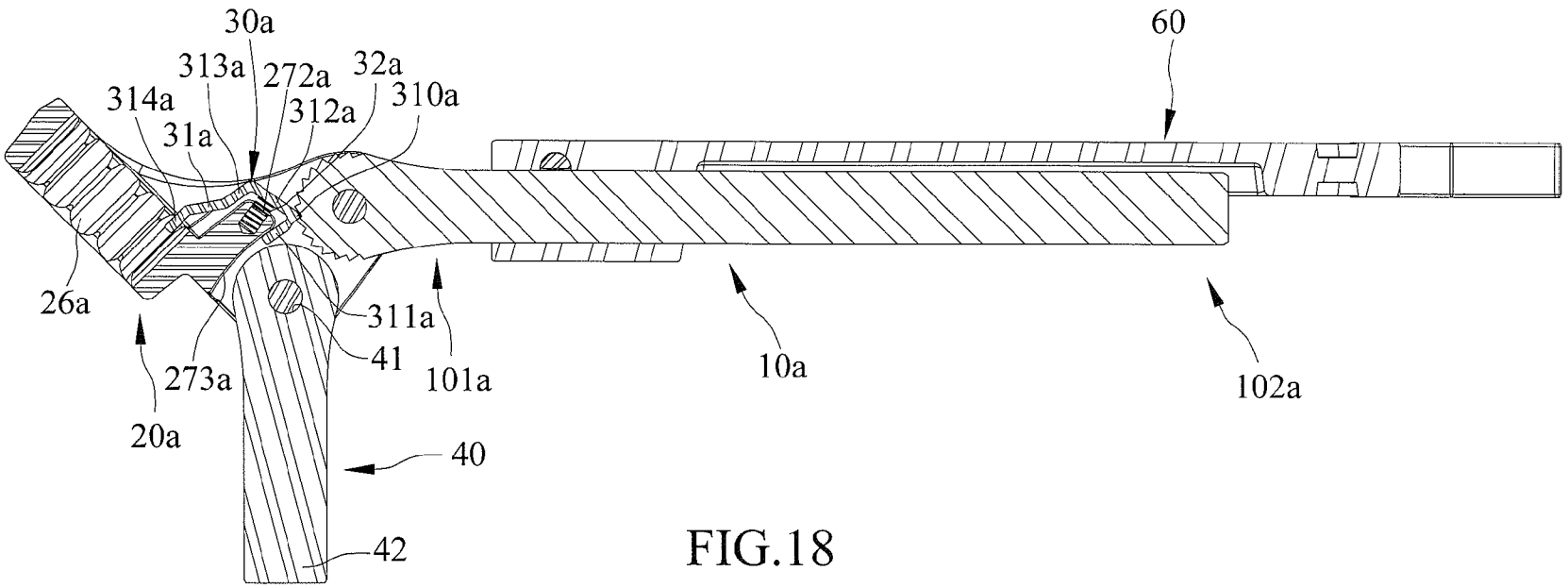
FIG. 18 is a cross-sectional view of the tool as shown in FIG. 15.
Figure 19:
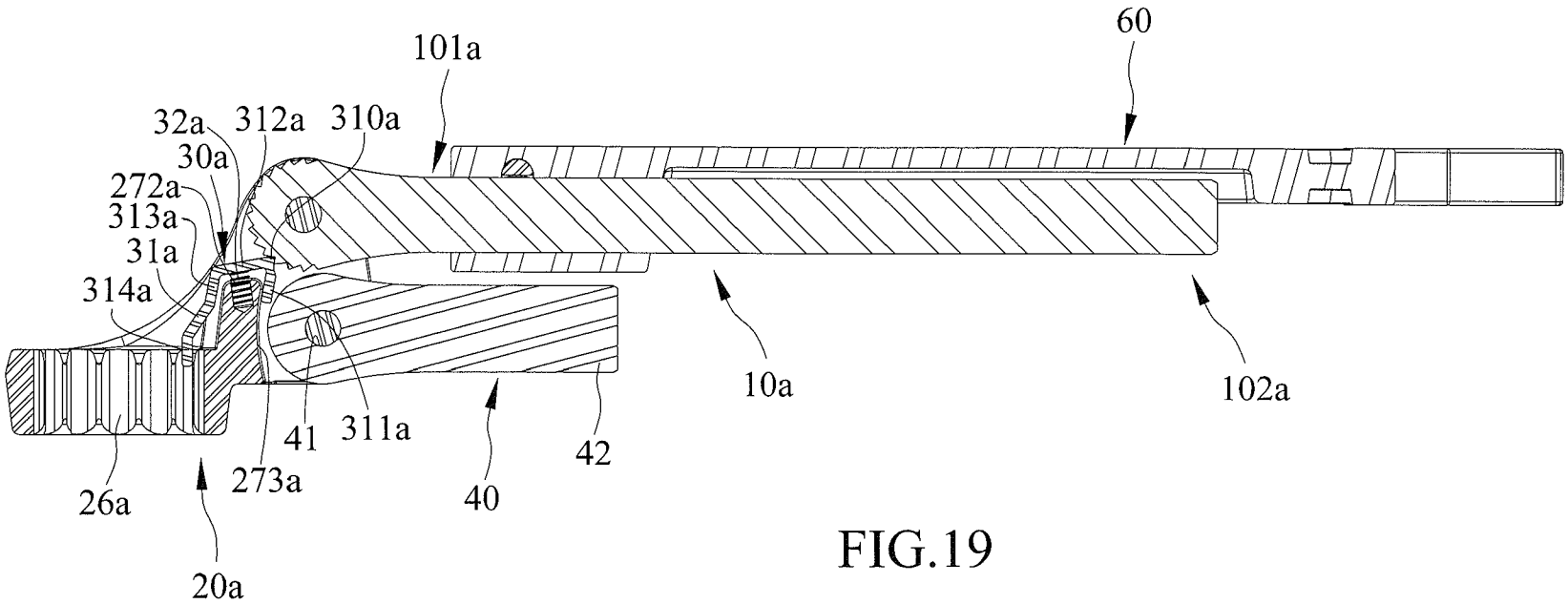
FIG. 19 is another cross-sectional view similar to FIG. 18, illustrating the second working head pivoted with respect to the pivotal end of the first working head.
Figure 20:
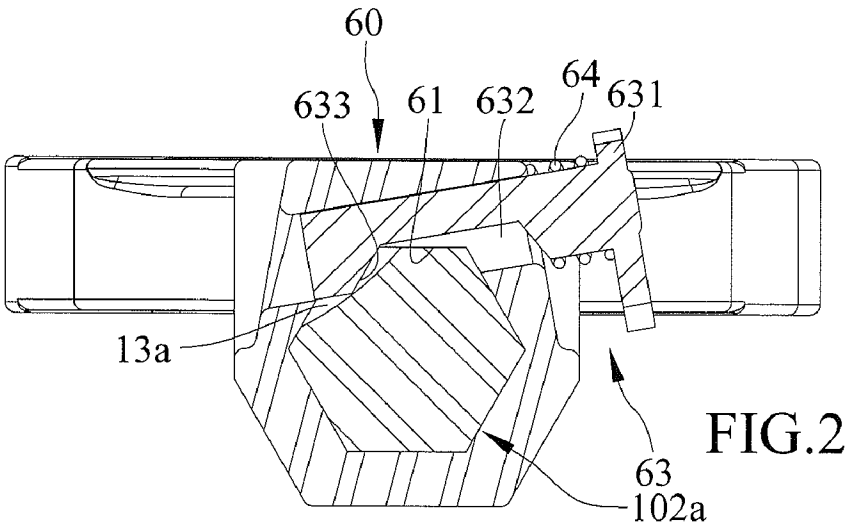
FIG. 20 is a cross-sectional view of the elongate rod of the tool as shown in FIG. 15, illustrating the elongate rod cannot move with respect to the handle.
Figure 21:
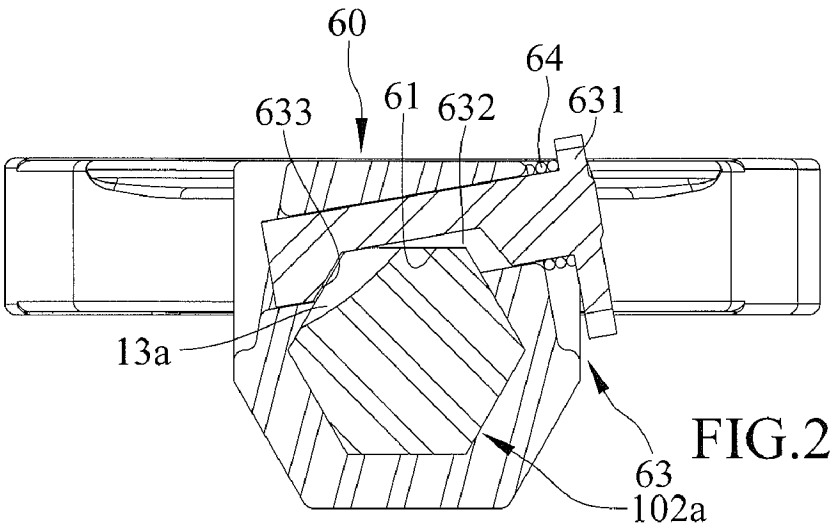
FIG. 21 is another cross-sectional view of the elongate rod of the tool as shown in FIG. 15, illustrating the elongate rod moveable with respect to the handle.
Figure 22:
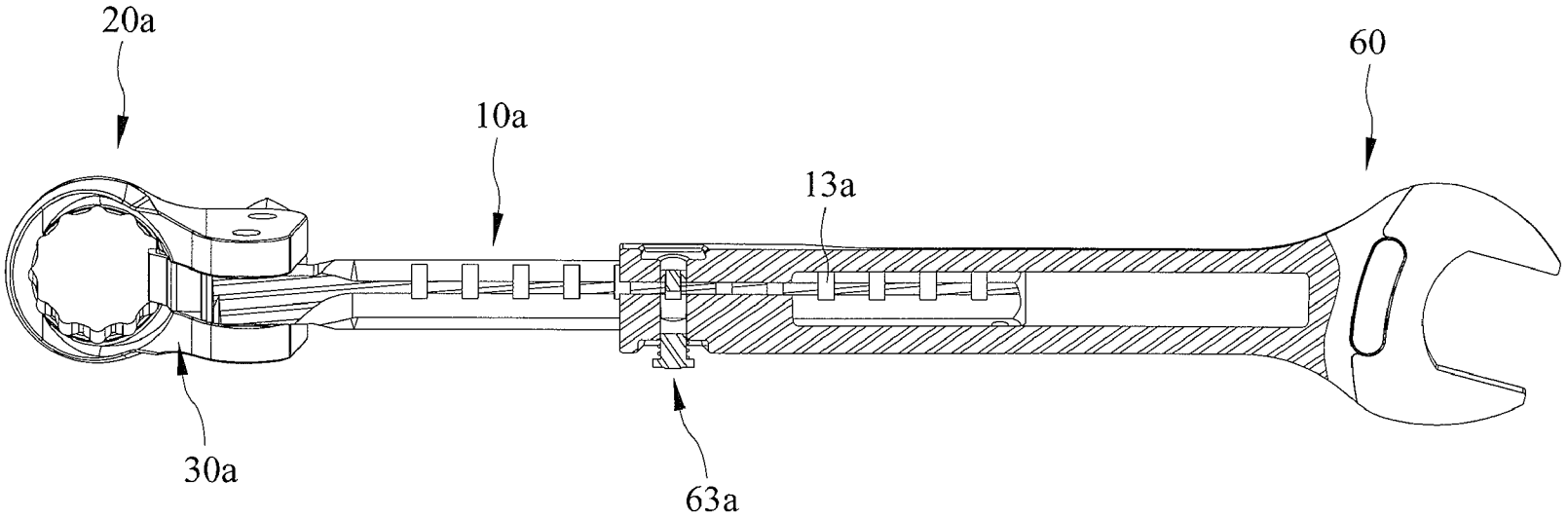
FIG. 22 is a partially, exploded, cross-sectional view of the tool as shown in FIG. 16.

Referring to FIGS. 12 and 13, while the handle 10 is going to be pivoted with respect to the first working head 20 along the second direction, the user has to press the positioning plate 31 to move the positioning unit 30 to be in the second position, and the first and second sections 311, 312 respectively detach from the retained and abutted sides 272, 273 to disengage the restricted portion 310 from the one tooth 11. Thus, the handle 10 can pivot with respect to the first working head 20 along the second direction.

FIGS. 15 through 22 show a tool with working heads and a positioning unit in accordance with a second embodiment of the present invention similar to the first embodiment, and the tool includes a handle 10*a*, a first working head 20*a*, a positioning unit 30*a*, a second working head 40 and an elongate rod 60.

The handle 10*a* includes a pivotal end 101*a*, a holding end 102*a*, teeth 11*a*, a pivotal hole 12*a* and a plurality positioning portions 13*a* and is similar to the handle 10 except for several features described below.

A proportion of the teeth 11*a* provided on the outer periphery of the pivotal end 101*a* is larger than that of the teeth 11 provided on the outer periphery of the pivotal end 101. An aperture 14*a* is formed on the distal end of the holding end 102*a*. A blocked element 15*a* and a spring 16*a* are disposed in the aperture 14*a*.

The first working head 20 includes a pivotal end 201*a*, a working end 202*a*, a first pivoted lug 21*a*, a first hole 211*a*, a second hole 212*a*, a second pivoted lug 22*a*, a first fixed hole 221, a second fixed hole 222*a*, a first axle 23*a*, a second axle 24*a*, a driving hole 26*a*, a connective portion 27*a*, an aperture 271*a*, a retained side 272*a* and an abutted side 273*a*.

The positioning unit 30*a* includes a positioning plate 31*a* and an elastic element 32*a*. First, second, third and fourth sections 311*a*, 312*a*, 313*a*, 314*a* and a restricted portion 310*a* are defined on the positioning plate 31*a*. The first working head 20*a* and the positioning unit 30*a* are respectively similar to the first working head 20 and the positioning unit 30*a* except for several features described below.

The connective portion 27*a* has first, second and third sides. The first side extends from the top surface of the working end 202*a* at nearly a right angle, the second side is opposite to the first side and defines the abutted side 273*a* and the third side faces the pivotal end 101*a* between the first and second sides and defines the retained side 272*a* and has the aperture 271*a*.

The second section 312*a* facing toward the third side of the connective portion 27*a* is pushed by the elastic element 32*a* outwardly.

The restricted portion 310*a* is protruded from the positioning plate 31*a* and, in this case, is defined at the intersection of the first and second sections 311*a*, 312*a*.

While the handle 10*a* is going to be pivoted with respect to the first working head 20*a* along the second direction, the user has to press the positioning plate 31*a* to move the positioning unit 30*a* to be in the second position, and the first section 311*a* detaches from the retained side 272*a* to disengage the restricted portion 310*a* from the one tooth 11*a*.

The elongate rod 60 is mounted onto the holding end 102*a* of the handle 10*a* and is adapted for increasing the entire length of the handle 10*a* adjustably. During use, users grip the elongate rod 60 to pivot the handle 10*a* with respect to the first working head 20*a*. It increases the length of a force arm, which is the distance from the connection of the first working head 20*a* and the handle 10*a* to the distal end of the elongate rod 60, and provides a more comfortable hold of the tool. Further, the elongate rod 60 has a working end 601 for driving fasteners or nuts and a coupled end 602 mounted onto the holding end 102*a*. The coupled end 602 is formed with a hexagonal mounted hole 61 mounted onto the holding end 102*a* and a through-hole 62 partially communicating with the mounted hole 61. A controller 63 and an elastic element 64 are provided at the through-hole 62. A direction of the mounted hole 61 is perpendicular to that of the through-hole 62. The controller 63 includes a head 631, an abutted surface 633 and a sunken portion 632 between the head 631 and the abutted surface 633. The controller 63 is inserted though the elastic element 64 and disposed in the through-hole 62. The sunken portion 632 allows the holding end 102*a* to be able to pass through the controller 63. The abutted surface 633 is selectively engaged with one positioning portion 13*a* for preventing the elongate rod 60 from sliding with respect to the handle 10*a*. The blocked element 15*a* can prevent the handle 10*a* from totally detaching from the elongate rod 60 via the spring 16*a*.

By pressing the head 631 of the controller 63 toward the mounted hole 61, the abutted surface 633 is forced to disengage from the one positioning portion 13*a* so that the elongate rod 60 is able to slide with respect to the handle 10*a*.

While several embodiments of the invention have been shown and described, it will be apparent to those skilled in the art that modifications may be made therein without departing from the scope and spirit of the present invention.

What is claimed is:

1. A tool comprising:

a handle including a pivotal end, a holding end held by a user in use of the tool and a plurality of teeth formed on an outer periphery of the pivotal end;

a first working head including a pivotal end coupled to the pivotal end of the handle pivotally, a working end engaged with a work piece desired to be driven and an aperture between the pivotal end of the first working head and the working end;

spaced first and second pivotal lugs at the pivotal end of the first working head and a driving hole formed on the working end of the first working head and adapted for engaging with the work piece;

a positioning unit including a positioning plate and an elastic element received in the aperture, with the positioning plate hooking the first working head and pressing the elastic element of the positioning unit respectively, with a restricted portion protruding from the positioning plate between two ends of the positioning plate toward the pivotal end of the handle; and a connective portion defined between the pivotal end of the first working head and the working end, with the aperture formed on the connective portion; wherein the connective portion has first, second and third sides, with the first side extending from the top surface of the working end and formed with the aperture, the second side opposite to the first side and defining a retained side and the third side facing the pivotal end of the first working head between the first and second sides and defining an abutted side, with one of the two ends of the positioning plate hooking the retained side, with the abutted side abutted against the positioning plate between the two ends of the positioning plate;

wherein the positioning unit is adjustable between a first position and a second position; wherein while the positioning unit is in the first position, the restricted portion is engaged with one tooth to fix the handle to the first working head; and wherein while the positioning unit is in the second position, the restricted portion is disengaged from the one tooth to pivot the handle with respect to the first working head.

2. The tool as claimed in claim 1 wherein the positioning plate is formed with first, second, third and fourth sections continuously coupled to one another in sequence, with the first section hooking the retained side, with the second section abutted against the abutted side and having the restricted portion, and with the third section pushed by the elastic element of the positioning unit outwardly.

3. The tool as claimed in claim 2 wherein the fourth section is bent from the third section and inserted into the driving hole for preventing the third section from deforming easily via a frequent push of the elastic element.

4. A tool comprising:

a handle including a pivotal end, a holding end held by a user in use of the tool and a plurality of teeth formed on an outer periphery of the pivotal end;

a first working head including a pivotal end coupled to the pivotal end of the handle pivotally, a working end engaged with a work piece desired to be driven and an aperture between the pivotal end of the first working head and the working end;

spaced first and second pivotal lugs at the pivotal end of the first working head and a driving hole formed on the working end of the first working head and adapted for engaging with the work piece;

a positioning unit including a positioning plate and an elastic element received in the aperture, with the positioning plate hooking the first working head and pressing the elastic element of the positioning unit respectively, with a restricted portion protruding from the positioning plate between two ends of the positioning plate toward the pivotal end of the handle; and a connective portion defined between the pivotal end of the first working head and the working end, with the aperture formed on the connective portion; wherein the connective portion has first, second and third sides, with the first side extending from the top surface of the working end, the second side opposite to the first side and defining an abutted side and the third side facing the pivotal end of the first working head between the first and second sides and defining a retained side and the aperture, with one of the two ends of the positioning plate hooking the retained side, with the abutted side abutted against positioning plate between the two ends of the positioning plate;

wherein the positioning unit is adjustable between a first position and a second position; wherein while the positioning unit is in the first position, the restricted portion is engaged with one tooth to fix the handle to the first working head; and wherein while the positioning unit is in the second position, the restricted portion is disengaged from the one tooth to pivot the handle with respect to the first working head.

5. The tool as claimed in claim 4 wherein the positioning plate is formed with first, second, third and fourth sections continuously coupled to one another in sequence, with the first section hooking the retained side, with the second section facing toward the third side of the connective portion and pushed by the elastic element of the positioning unit outwardly, with the restricted portion defined at an intersection of the first and second sections.

6. A tool comprising:

a handle including a pivotal end, a holding end held by a user in use of the tool and a plurality of teeth formed on an outer periphery of the pivotal end;

a first working head including a pivotal end coupled to the pivotal end of the handle pivotally, a working end engaged with a work piece desired to be driven and an aperture between the pivotal end of the first working head and the working end;

a second working head pivotally coupled to the pivotal end of the first working head; and a positioning unit including a positioning plate and an elastic element received in the aperture, with the positioning plate hooking the first working head and pressing the elastic element of the positioning unit respectively, with a restricted portion protruding from the positioning plate between two ends of the positioning plate toward the pivotal end of the handle;

wherein the pivotal end of the first working head includes a receiving hole which receives a biasing member; wherein the pivotal ends of the handle and the second working head are respectively pivotally coupled to the pivotal end of the first working head and respectively biased by the biasing member simultaneously;

wherein the positioning unit is adjustable between a first position and a second position; wherein while the positioning unit is in the first position, the restricted portion is engaged with one tooth to fix the handle to the first working head; and wherein while the positioning unit is in the second position, the restricted portion is disengaged from the one tooth to pivot the handle with respect to the first working head.

7. The tool as claimed in claim 6, further comprising spaced first and second pivotal lugs at the pivotal end of the first working head and a driving hole formed on the working end of the first working head and adapted for engaging with the work piece.

8. The tool as claimed in claim 6 wherein the second working head includes a pivoted hole formed at a first end thereof and a driving portion provided at a second end thereof opposite to the pivoted hole and engaged with fasteners.

9. A tool comprising:

a handle including a pivotal end, a holding end held by a user in use of the tool and a plurality of teeth formed on an outer periphery of the pivotal end;

a first working head including a pivotal end coupled to the pivotal end of the handle pivotally, a working end engaged with a work piece desired to be driven and an aperture between the pivotal end and the working end;

a second working head pivotally coupled to the pivotal end of the first working head; and a positioning unit including a positioning plate and an elastic element received in the aperture, with the positioning plate hooking the first working head and pressing the elastic element of the positioning unit respectively, with a restricted portion protruding from of the positioning plate between two ends of the positioning plate toward the pivotal end of the handle;

wherein the pivotal end of the first working head includes a receiving hole; wherein the pivotal ends of the handle and the second working head are respectively pivotally coupled to the pivotal end of the first working head;

wherein the positioning unit is adjustable between a first position and a second position; wherein while the positioning unit is in the first position, the restricted portion is engaged with one tooth to fix the handle to the first working head; and wherein while the positioning unit is in the second position, the restricted portion is disengaged from the one tooth to pivot the handle with respect to the first working head.

10. The tool as claimed in claim 9 wherein the second working head includes a pivoted hole formed at a first end thereof and a driving portion provided at a second end thereof opposite to the pivoted hole and engaged with fasteners.

11. A tool comprising:

a handle including a pivotal end, a holding end held by a user in use of the tool and a plurality of teeth formed on an outer periphery of the pivotal end;

a first working head including a pivotal end coupled to the pivotal end of the handle pivotally, a working end engaged with a work piece desired to be driven and an aperture between the pivotal end and the working end;

a positioning unit including a positioning plate and an elastic element received in the aperture, with the positioning plate hooking the first working head and pressing the elastic element of the positioning unit respectively, with a restricted portion protruding from the positioning plate between two ends of the positioning plate toward the pivotal end; and an elongate rod, which is coupled to the holding end and includes a mounted hole mounted on the holding end of the handle, a through-hole partially communicating with the mounted hole, a controller and an elastic element, and a plurality of evenly spaced positioning portions formed on the holding end linearly, with a direction of the mounted hole being perpendicular to that of the through-hole, with the controller inserted through the elastic element of the elongate rod and disposed in the through-hole, with the controller selectively engaged with one of the positioning portions for preventing the elongate rod from sliding with respect to handle or allowing the elongate rod to slide with respect to the handle;

wherein the positioning unit is adjustable between a first position and a second position; wherein while the positioning unit is in the first position, the restricted portion is engaged with one tooth to fix the handle to the first working head; and wherein while the positioning unit is in the second position, the restricted portion is disengaged from the one tooth to pivot the handle with respect to the first working head.

12. The tool as claimed in claim 11, further comprising a second working head pivotally coupled to the pivotal end of the first working head.

13. The tool as claim in claim 11 wherein the controller includes a head, an abutted surface and a sunken portion between the head and the abutted surface; wherein the sunken portion allows the holding end to pass through the controller; wherein the abutted surface is selectively engaged with one of the evenly spaced positioning portions for preventing the elongate rod from sliding with respect to the handle; and wherein the abutted surface is forced to disengage from the one of the evenly spaced positioning portions by pressing the head of the controller toward the mounted hole with the elongate rod sliding with respect to the handle.

14. The tool as claimed in claim 11 further comprising an aperture formed on the distal end of the holding end opposite to the pivotal end of the handle and a blocked element and a spring both disposed in the aperture; and wherein the blocked element prevents the handle from totally detaching from the elongate rod via the spring.

* * * * *